US005823345A

United States Patent [19]

Nask et al.

[11] Patent Number: 5,823,345

[45] Date of Patent: Oct. 20, 1998

[54] STACKABLE RECEPTACLE ASSEMBLY FOR POURABLE PRODUCTS

[75] Inventors: Aleene F. Nask, West Harrison, N.Y.; Timmy L. Willett, Waverly, Ky.; Richard Rhodes, Northport, N.Y.

[73] Assignees: Berry Plastics Corporation, Evansville, Ind.; Olin Corporation, Cheshire, Conn.

[21] Appl. No.: 899,971

[22] Filed: Jul. 24, 1997

[51] Int. Cl.[6] ..... B65D 21/032; B65D 21/036; B65D 21/02

[52] U.S. Cl. ..... 206/509; 206/503; 206/508; 222/143

[58] Field of Search ..... 222/143; 206/503, 206/508, 509

[56] References Cited

U.S. PATENT DOCUMENTS

| | | | |
|---|---|---|---|
| D. 205,319 | 7/1966 | Klein | D58/17 |
| D. 218,359 | 8/1970 | Marsh | D49/35 |
| D. 231,184 | 4/1974 | Brown et al. | D7/189 |
| D. 248,090 | 6/1978 | Box | D9/237 |
| D. 270,675 | 9/1983 | Parker | D34/5 |
| D. 284,728 | 7/1986 | Trivison | D7/79 |
| D. 296,671 | 7/1988 | Jordan | D9/431 |
| D. 306,830 | 3/1990 | DeCoster | D9/435 |
| D. 307,716 | 5/1990 | Fitzloff et al. | D9/424 |
| D. 311,334 | 10/1990 | Flynn et al. | D9/424 |
| D. 313,555 | 1/1991 | Jordi | D9/424 |
| D. 316,674 | 5/1991 | Poirier | D9/424 |
| D. 322,760 | 12/1991 | Blanchette | D9/435 |
| D. 323,912 | 2/1992 | Delmerico | D34/5 |
| D. 323,914 | 2/1992 | Doxey et al. | D34/5 |
| D. 326,945 | 6/1992 | Howitt | D34/40 |
| D. 329,200 | 9/1992 | Collins | D9/454 |
| D. 330,674 | 11/1992 | Lyon | D9/420 |
| D. 351,791 | 10/1994 | Morris, Sr. | D9/425 |
| D. 351,792 | 10/1994 | Morris, Sr. | D9/425 |
| D. 353,743 | 12/1994 | Jochem et al. | D7/612 |
| D. 358,327 | 5/1995 | Tomasello | D9/424 |
| D. 362,180 | 9/1995 | Haines | D9/424 |
| 2,120,487 | 6/1938 | Conner | 220/66 |
| 2,436,097 | 2/1948 | Clarke | 65/59 |
| 2,780,259 | 2/1957 | Nalle, Jr. | 150/5 |
| 3,056,525 | 10/1962 | Deinert | 220/21 |
| 3,117,692 | 1/1964 | Carpenter et al. | 220/60 |
| 3,338,468 | 8/1967 | Wilson | 220/97 |
| 3,383,009 | 5/1968 | Weikert | 220/97 |
| 3,406,855 | 10/1968 | McKechnie | 220/1.5 |
| 3,419,184 | 12/1968 | Asenbauer | 220/97 |
| 3,447,714 | 6/1969 | Elliot | 220/97 |
| 3,526,334 | 9/1970 | Ashton et al. | 220/23.83 |
| 3,598,271 | 8/1971 | Holley | 215/41 |
| 3,759,416 | 9/1973 | Constantine | 220/97 |
| 3,765,574 | 10/1973 | Urquiza | 222/143 |
| 3,957,097 | 5/1976 | Swett | 150/0.5 |
| 3,989,142 | 11/1976 | Gwilliam Jr. et al. | 206/508 |
| 4,033,473 | 7/1977 | Raley et al. | 220/66 |
| 4,113,095 | 9/1978 | Dietz et al. | 206/508 |

(List continued on next page.)

*Primary Examiner*—Andres Kashnikow
*Assistant Examiner*—Keats Quinalty
*Attorney, Agent, or Firm*—William A. Simons; Thomas F. Presson; Wiggin & Dana

[57] ABSTRACT

A modular stackable receptacle for pool chemicals or the like includes an upper cover and a lower container portion. The cover includes a continuous rectilinear sidewall having a latch ring on an inner surface thereof. An upper surface of the cover includes a product dispensing pour spout which receives a removable closure cap. The upper surface of the cover also includes a raised crown portion which is coplanar with the closure cap. Both the closure cap and the crown portion have stacking and aligning projections which cooperate with respective recesses formed in the bottom wall of the container portion, which recesses facilitate stable stacking of the receptacles, one atop another. The container portion has a continuous sidewall which includes an upper outwardly projecting rim and an outwardly projecting catch ring that is adapted to interlock with the latch ring on the cover, whereby the cover cannot be readily removed from the container.

15 Claims, 3 Drawing Sheets

U.S. PATENT DOCUMENTS

| | | | |
|---|---|---|---|
| 4,286,713 | 9/1981 | Marchais | 206/508 |
| 4,288,000 | 9/1981 | Luker et al. | 220/281 |
| 4,351,454 | 9/1982 | Maynard, Jr. | 222/143 |
| 4,541,529 | 9/1985 | Hestehave et al. | 222/143 |
| 4,632,268 | 12/1986 | Melzi et al. | 220/1 |
| 4,708,258 | 11/1987 | Shaw et al. | 220/288 |
| 4,759,478 | 7/1988 | Richardson et al. | 222/556 |
| 4,779,754 | 10/1988 | Ten Eyck et al. | 220/66 |
| 4,819,795 | 4/1989 | Swaney | 206/278 |
| 4,986,433 | 1/1991 | Davis | 220/23.8 |
| 5,143,219 | 9/1992 | Yates, Jr. | 206/508 |
| 5,199,570 | 4/1993 | McKenzie | 206/503 |
| 5,211,289 | 5/1993 | Matthews | 206/508 |
| 5,269,438 | 12/1993 | Kelsey | 220/766 |
| 5,310,074 | 5/1994 | Jochem et al. | 220/296 |
| 5,337,910 | 8/1994 | Picozza | 220/203 |
| 5,356,026 | 10/1994 | Andress et al. | 220/306 |
| 5,377,858 | 1/1995 | Morris, Sr. | 220/254 |
| 5,392,945 | 2/1995 | Syrek | 220/608 |
| 5,535,910 | 7/1996 | Cassel | 220/212 |
| B1 4,708,258 | 11/1987 | Shaw et al. | 220/288 |

STACKABLE RECEPTACLE ASSEMBLY FOR POURABLE PRODUCTS

TECHNICAL FIELD

This invention relates to a receptacle assembly for containing pool chemicals or other products; and more particularly, to a stackable receptacle assembly which can be manually used one-handedly to pour product from the receptacle assembly. The receptacle assembly of this invention is compactly configured, and can be readily filled and capped on a production assembly line.

BACKGROUND ART

Receptacles for pourable products, such as pool chemicals, have typically taken the form of cylinders. The use of cylindrical receptacle configurations provides a readily transportable and stackable marketing and merchandising system, but they do not optimize utilization of shipping or merchandising shelf space. Cylindrical pool chemical packaging systems are visually acceptable but are expensive to ship due to their inefficient utilization of shipping space. Point-of-sale locations which have limited shelf space likewise cannot optimize whatever shelf space is available to display product when a cylindrical package is utilized. The more product a merchant can place on his or her shelves, the greater the opportunity for product sales.

What is needed is a spatially efficient receptacle for pool chemicals, or other pourable products, which receptacle presents a visually attractive package to the consumer; is easy to use by the consumer; occupies minimal volume for shipping and stacking; is stablely stackable; and maximizes the density of product on point-of-sale shelves.

DISCLOSURE OF THE INVENTION

This invention is directed to a product-dispensing receptacle assembly for pool chemicals or the like, that is spatially efficient, can be easily used by the consumer, and can be easily filled in a production line filling system. The receptacle assembly includes an upper cover component and a lower container component which can be securely affixed to each other after the receptacle assembly has been filled with product. The cover component includes a product-dispensing spout; and a closure cap is removably affixed to the product-dispensing spout. The closure cap is threaded onto a neck or collar on the cover component which forms the product-dispensing spout so as to selectively close the receptacle assembly. The receptacle assembly includes stacking projections on the cover component and on the closure cap; and stacking recesses in a bottom wall of the container component which mate with the stacking projections on the cover component and closure cap.

Specifically, the cover component includes a continuous downwardly extending sidewall which has a locking flange on an inside portion thereof; and an upper surface having the product-dispensing opening collar and an upwardly extending raised crown portion. The upwardly crown portion includes a stacking projection on its upper surface. The closure cap also includes a stacking projection on its upper surface, and the upper surfaces of the closure cap and the crown of the cover component are essentially coplanar so as to provide a stable surface on which another one of the receptacle assemblies can be stacked.

The container portion includes an essentially rectangular bottom wall and a continuous sidewall which extends upwardly and outwardly from the bottom wall. The sidewall includes catch flanges which are integral with an upper edge part of the container sidewall for interfitting with the cover component latch flange. The container bottom wall is provided with first and second stacking recesses for receiving the first and second stacking projections on the cover component of a lower receptacle assembly.

It is therefore an object of this invention to provide a compact and spatially efficient receptacle assembly for storing and dispensing a product such as a pool chemical or the like.

It is an additional object of this invention to provide receptacle assemblies of the character described which can be stacked on top of each other so as to form a space-conserving assemblage of receptacles.

It is a further object of this invention to provide a receptacle assembly of the character described wherein the receptacles can be securely stacked on top of each other due to the inclusion of mating stacking projections and recesses on vertically adjacent receptacles in a stack thereof.

It is another object of this invention to provide a receptacle assembly of the character described which is formed from two components, an upper cover, and a lower container component, which, when assembled fit securely together.

It is yet another object of this invention to provide a receptacle assembly of the character described which can be readily filled with product and capped on an assembly line.

It is a further object of this invention to provide a receptacle assembly of the character described which can be manipulated with only one hand to dispense product therefrom.

These and other objects and advantages of the invention will become more readily apparent from the following detailed description of the invention when taken in conjunction with the accompanying drawings, in which:

BEST MODE FOR CARRYING OUT THE INVENTION

Figure 1:
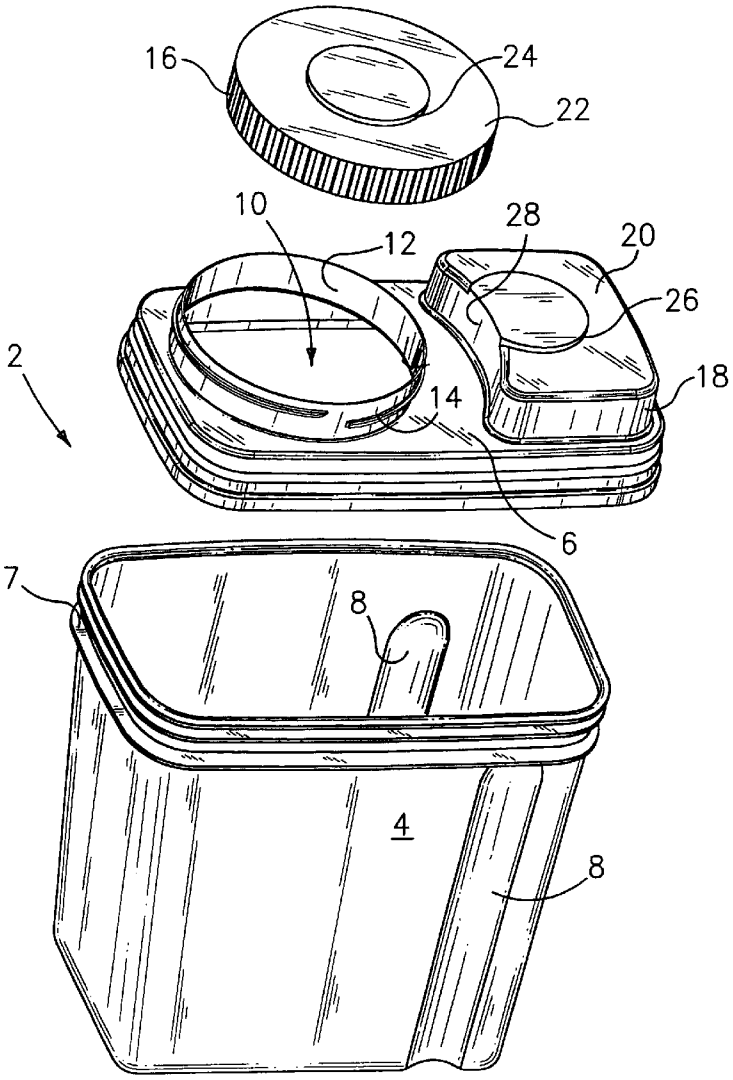
FIG. 1 is an exploded perspective view of a receptacle assembly which is formed in accordance with this invention.
Figure 2:
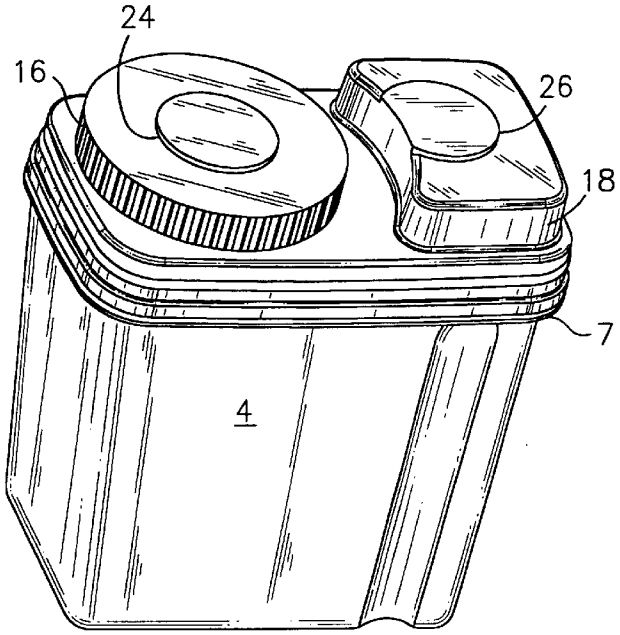
FIG. 2 is a perspective view of an assembled and closed receptacle which is formed in accordance with this invention.

Referring now to the drawings, a preferred embodiment of the receptacle assembly, which is denoted generally by the numeral 2, is shown in FIGS. 1 and 2. The receptacle assembly 2 includes a lower container portion 4 and an upper cover portion 6. The container portion 4 has a vertically elongated recess 8 in its sidewall which facilitates gripping of the receptacle with one hand while pouring contents from the receptacle. The container 4 is also provided with an outwardly projecting stabilizer flange 7 which serves to strengthen and stabilize the container 4.

The cover portion 6 includes a dispensing opening 10 which is surrounded by a projecting neck 12 so as to form a product-dispensing spout. The neck 12 is provided with an outer broken thread 14 that facilitates securement of a closure cap 16 to the receptacle 2. The connection between the cap 16 and the neck 12 is preferably constructed in the manner described in U.S. Pat. No. 5,310,074, granted May 10, 1994 to D. J. Jochem et al, the disclosure of which is incorporated herein in its entirety. The cover portion 6 also includes a raised crown 18 which has an upper surface 20 that is coplanar with the upper surface 22 of the cap 16 when the latter is tightly screwed down onto the neck 12. The upper cap surface 22 is provided with a configured boss 24 and the upper crown surface 20 is also provided with a configured boss 26. The bosses 24 and 26 are preferably circular, and serve as stacking and alignment stabilizers when the receptacles 2 are stacked one atop another. It will be noted that the crown 18 has an inner concave surface 28 which faces the cap 16 and allows gripping of the cap 16 to open the receptacle 2. The crown 18 serves to stiffen and strengthen the cover 6, and also assists in the stacking of the receptacles.

Figure 3:
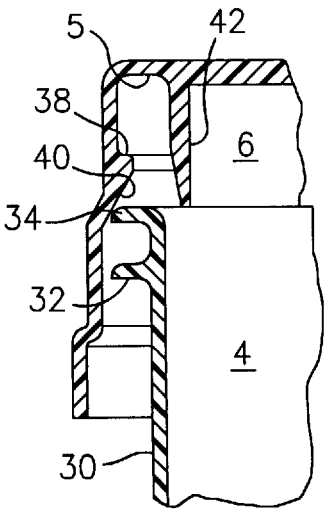
FIG. 3 is a fragmented sectional view of the locking mechanism by which the receptacle cover and container portion are firmly connected together prior to locking.
Figure 4:
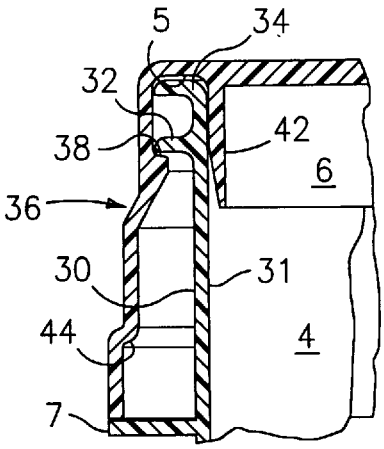
FIG. 4 is a view similar to FIG. 3, but showing the locking mechanism in its locked condition.

FIGS. 3 and 4 illustrate the interlocking mechanisms that are built into the container portion 4 and the cover portion 6 of the receptacle 2. The container side wall 30 includes an outwardly projecting latch ring 32 which is offset downwardly from the upper rim 34 of the container 4. The cover 6 includes an outer downwardly extending side flange 36 having an inwardly projecting catch ring 38 which is upwardly adjacent to a camming surface 40. The cover 6 also includes a downwardly depending wiper ring 42. Below the latch ring 32 and camming surface 40 is disposed a cover-centering ring 44 which serves to center the cover 6 relative to the container 4 as the former is lowered and pressed down upon the latter. FIG. 4 shows the cover 6 pressed down upon the container 4 with the catch ring 38 firmly locked against the latch ring 32. The wiper ring 42 is firmly pressed against the inner surface 31 of the container wall 30. It will be appreciated that when the cover 6 is pressed down upon the container 4, contact between the container rim 34 and the camming ring 40 will momentarily deflect the side flange 36 outwardly so that the latch ring 32 can slide past the container rim 34 and the catch ring 38. When the cover 6 is fully telescoped over the container 4 as shown in FIG. 4, the catch ring 38 will spring back to the latching position that is shown in FIG. 4. Likewise, when the cover 6 is fully telescoped over the container 4 as shown in FIG. 4, the container rim 34 will be jammed against the under surface 5 of the cover 6 and the cover 6 will contact the container stabilizer flange 7, as shown in FIG. 4. Thus the cover 6 will be firmly attached to the container 4. The aforesaid securement mechanism allows the container 4 to be filled with product on a production line, and allows a subsequent closure of the container 4 with the cover 6 by simply pressing the cover 6 down upon the filled container 4 at a closure station on the production line. It will be noted that the fully assembled receptacle 2 is a torsionally stable product due in part to the several stabilizing flanges on the container 4 and the cover 6.

Figure 5:
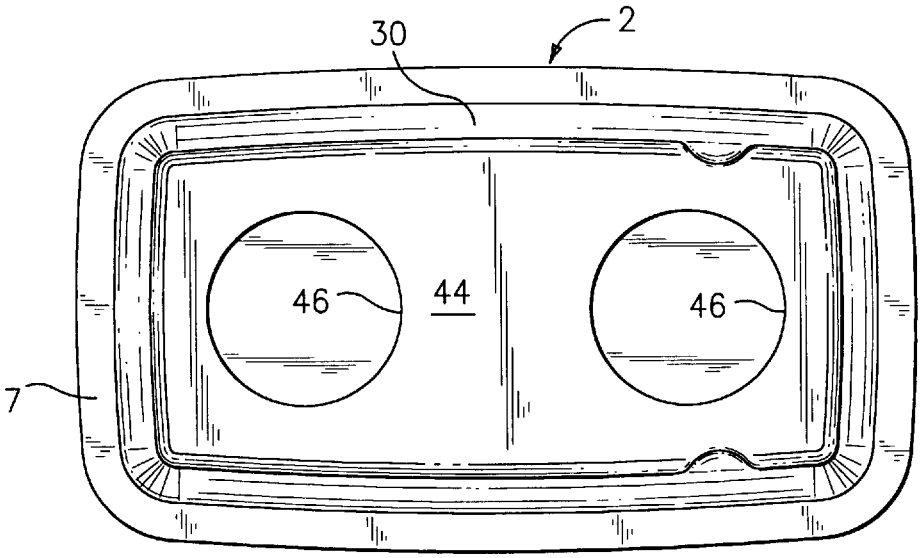
FIG. 5 is a bottom plan view of the receptacle assembly.
Figure 6:
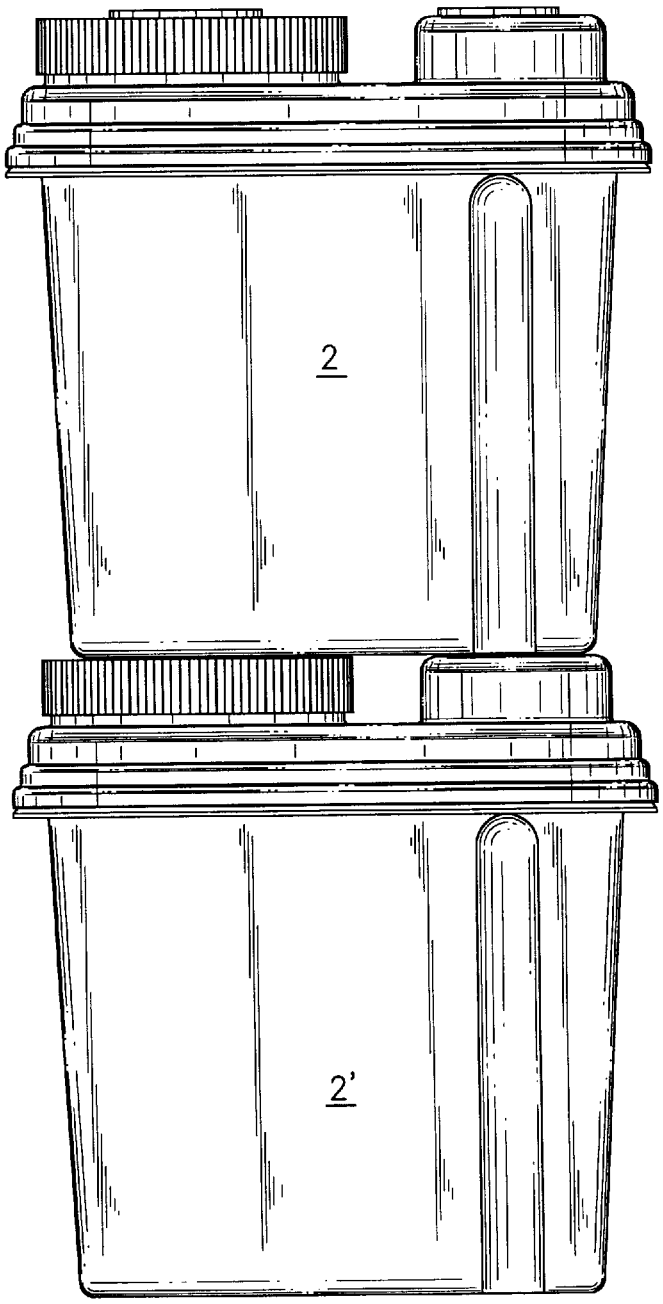
FIG. 6 is a side elevational view of two of the receptacle assemblies stacked one atop another.

Referring to FIG. 5, there is shown the bottom surface 44 of the receptacle assembly 2. The bottom 44 of the receptacle 2 is provided with two configured recesses 46 which cooperate with the bosses 24 and 26 on the cover 6 to stabilize stacking of receptacles 2 and 2', as shown in FIG. 6.

It will be appreciated that the receptacle assembly of this invention is spatially efficient, i.e., it occupies a minimum amount of shelf and storage space for any given volume of product. The assembly is easy to fill with product on a production line and easy to close. The receptacle assemblies are also structurally stable and can be securely stacked one atop another at the point of sale and when palletized for shipping.

Since many changes and variations of the disclosed embodiment of the invention may be made without departing from the inventive concept, it is not intended to limit the invention otherwise than as required by the appended claims.

What is claimed is:

1. A modular stackable receptacle assembly for holding a pourable product, said receptacle assembly comprising:

a lower rectilinear container having a continuous sidewall and a bottom wall which is integral with said sidewall, said bottom wall including first and second alignment and stacking recesses;

an upper rectilinear cover fitted onto said container, said cover including a raised crown part disposed to one side of said cover, said crown part having an upper surface;

a raised first alignment and stacking projection on said upper surface of said crown part;

said cover further including a product pouring spout disposed on a side of said cover opposite to said crown part;

a closure cap closing said pouring spout, said closure cap including an upper surface which is essentially coplanar with said crown part upper surface;

a raised second alignment and stacking projection on said upper surface of said closure cap; and said first and second alignment and stacking recesses in said lower rectilinear container capable of receiving the raised first and second alignment and stacking projections and thereby providing for aligned and stable stacking of a plurality of receptacle assemblies.

2. The receptacle assembly of claim 1, wherein opposite sides of the container include inwardly and upwardly extending recessed hand gripping grooves in said sidewall.

3. The receptacle assembly of claim 1, wherein said crown part of the cover includes a concavely curved sidewall facing said pouring spout, said concavely curved side wall being operable to stiffen said cover.

4. The receptacle assembly of claim 1, wherein said container has an upper rim with an outwardly projecting latch thereon, and said cover has a downwardly extending side flange with an inwardly projecting catch ring thereon, said latch and said catch ring being operable to secure said cover to said container when said cover is pressed downwardly onto said container.

5. A cover for closing a modular stackable receptacle which receptacle is operable to hold a pourable product, said cover comprising a rectilinear body which is adapted to be fitted onto a retaining portion of the receptacle, said body including a raised crown part disposed to one side of said body, said crown part having an upper surface;

a raised first alignment and stacking projection formed on top of said upper surface of said crown part; and said body further including a product pouring spout disposed on a side of said body opposite to said crown part.

6. The receptacle cover of claim 5 wherein said crown part includes a concavely curved sidewall facing said pouring spout, said concavely curved side wall being operable to stiffen said cover.

7. The receptacle cover of claim 5 comprising a tubular neck forming said pouring spout, said neck having a screw thread formed on its exterior surface; and an internally threaded closure cap threaded onto said neck operable to close said pouring spout.

8. The receptacle cover of claim 7 wherein said closure cap includes an upper surface which is coplanar with said upper surface on said crown part; and a raised second alignment and stacking projection formed on said upper surface of said closure cap.

9. The receptacle cover of claim 5 wherein said body includes a downwardly extending side flange, said side flange including an inwardly projecting catch ring extending around said side flange, said catch being operable to secure said cover to a remaining part of the receptacle when the cover is pressed downwardly over the remaining part of the receptacle.

10. The receptacle assembly as claimed in claim 1 wherein said assembly contains a pool chemical.

11. A stacked plurality of receptacle assemblies of claim 1.

12. The stacked plurality of receptacle assemblies as claimed in claim 11 wherein neither the upper surface of the raised crown part nor the upper surface of the closure cap is received into the first and second alignment and stacking recesses.

13. A modular stackable receptacle assembly for holding a pourable product, said receptacle assembly comprising:

a lower rectilinear container having a continuous sidewall and a bottom wall which is integral with said sidewall;

one or more first alignment surfaces on said bottom wall that are not coplanar with said bottom wall;

an upper rectilinear cover fitted onto said container, said cover including a raised crown part disposed to one side of said cover, said crown part having an upper surface;

a second alignment surface on said upper surface of said crown part that is not coplanar with said crown part;

said cover further including a product pouring spout disposed on a side of said cover opposite to said crown part;

a closure cap for closing said pouring spout, said closure cap including an upper surface which is essentially coplanar with said crown part upper surface; and a third alignment surface on said closure cap upper surface that is not coplanar with said closure cap upper surface;

said one or more first alignment surfaces on said bottom wall capable of forming a mating relationship with the second and third alignment surfaces and thereby providing for aligned and stable stacking of a plurality of receptacle assemblies.

14. A cover for closing a modular stackable receptacle which receptacle is operable to hold a pourable product, said cover comprising:

a rectilinear body which is adapted to be fitted onto a retaining portion of the receptacle, said body includes a raised crown part disposed to one side of said body, said crown part having an upper surface;

a first alignment surface on said upper surface of said raised crown part that is not coplanar with said upper surface of said raised crown part; and a product pouring spout disposed on a side of said body opposite to said crown part.

15. The cover of claim 14 further comprising:

a tubular neck forming said pouring spout, said neck having a screw thread formed on its exterior surface;

a closure cap operable to close said pouring spout;

said closure cap including an upper surface that is coplanar with said upper surface on said crown part; and a second alignment surface on said upper surface of said closure cap that is not coplanar with said upper surface.

* * * * *